US010172186B2

(12) United States Patent
Yoshidome

(10) Patent No.: US 10,172,186 B2
(45) Date of Patent: Jan. 1, 2019

(54) CERAMIC CYLINDRICAL HEATER

(71) Applicant: KYOCERA Corporation, Kyoto-shi, Kyoto (JP)

(72) Inventor: Hideaki Yoshidome, Kirishima (JP)

(73) Assignee: Kyocera Corporation, Kyoto (JP)

( * ) Notice: Subject to any disclaimer, the term of this patent is extended or adjusted under 35 U.S.C. 154(b) by 0 days.

(21) Appl. No.: 15/564,837

(22) PCT Filed: Apr. 11, 2016

(86) PCT No.: PCT/JP2016/061647
§ 371 (c)(1),
(2) Date: Oct. 6, 2017

(87) PCT Pub. No.: WO2016/163558
PCT Pub. Date: Oct. 13, 2016

(65) Prior Publication Data

US 2018/0110096 A1 Apr. 19, 2018

(30) Foreign Application Priority Data

Apr. 10, 2015 (JP) ..... 2015-081106

(51) Int. Cl.
*H05B 1/02* (2006.01)
*H05B 3/08* (2006.01)
*H05B 3/06* (2006.01)
*H05B 3/48* (2006.01)

(52) U.S. Cl.
CPC ..... *H05B 3/08* (2013.01); *H05B 3/06* (2013.01); *H05B 3/48* (2013.01)

(58) Field of Classification Search
CPC ..... H05B 3/08; H05B 3/48; H05B 3/46
USPC ..... 219/544, 552, 504, 505
See application file for complete search history.

(56) References Cited

U.S. PATENT DOCUMENTS 5,300,809 A * 4/1994 Nakamura ..... H01L 23/3735 257/684
5,492,842 A * 2/1996 Eytcheson ..... H02M 7/003 29/593
2011/0235980 A1* 9/2011 Sato ..... G02B 6/4206 385/93

FOREIGN PATENT DOCUMENTS

JP 06-069241 U 9/1994

* cited by examiner

*Primary Examiner* — Mark Paschall
(74) *Attorney, Agent, or Firm* — Volpe and Koenig, P.C.

(57) ABSTRACT

A heater includes a ceramic body having a pillar or cylindrical shape; a heat generating resistor disposed in an interior of the ceramic body; a metallic layer which is disposed on an outer peripheral surface of the ceramic body and extends along a circumferential direction thereof; a flange bonded to the metallic layer via a bonding material, the bonding material including a meniscus part extending from the metallic layer to the flange; and a metallic wire which is disposed in an interior of the meniscus part on the outer peripheral surface of the ceramic body and extends along the circumferential direction.

5 Claims, 6 Drawing Sheets

CERAMIC CYLINDRICAL HEATER

TECHNICAL FIELD

The present disclosure relates to a heater used for liquid heaters, powder heaters, gas heaters, oxygen sensor heaters, soldering iron heaters, and the like.

BACKGROUND ART

A ceramic flange structure described for example in Japanese Unexamined Utility Model Publication JP-U 6-69241 (1994) (hereinafter, referred to also as Patent Literature 1) is known as a heater. The ceramic flange structure described in Patent Literature 1 includes a ceramic cylindrical body provided with a heater in an interior thereof, and a flange bonded to the ceramic cylindrical body with a bonding material.

SUMMARY OF INVENTION

A heater according to an aspect includes a ceramic body having a pillar or cylindrical shape; a heat generating resistor disposed in an interior of the ceramic body; a metallic layer which is disposed on an outer peripheral surface of the ceramic body and extends along a circumferential direction thereof; a flange bonded to the metallic layer via a bonding material, the bonding material including a meniscus part extending from the metallic layer to the flange; and a metallic wire which is disposed in an interior of the meniscus part on the outer peripheral surface of the ceramic body and extends along the circumferential direction.

DESCRIPTION OF EMBODIMENTS

Figure 1:
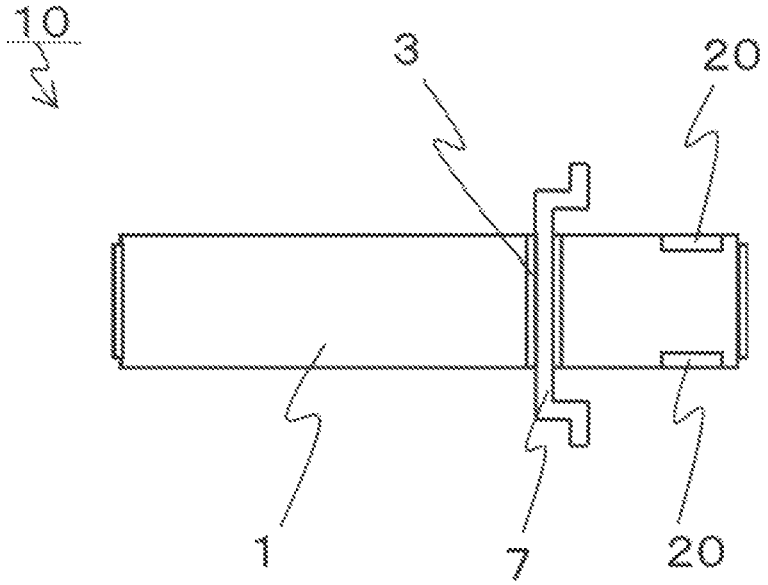
FIG. 1 is a side view illustrating one embodiment of a heater.
Figure 2:
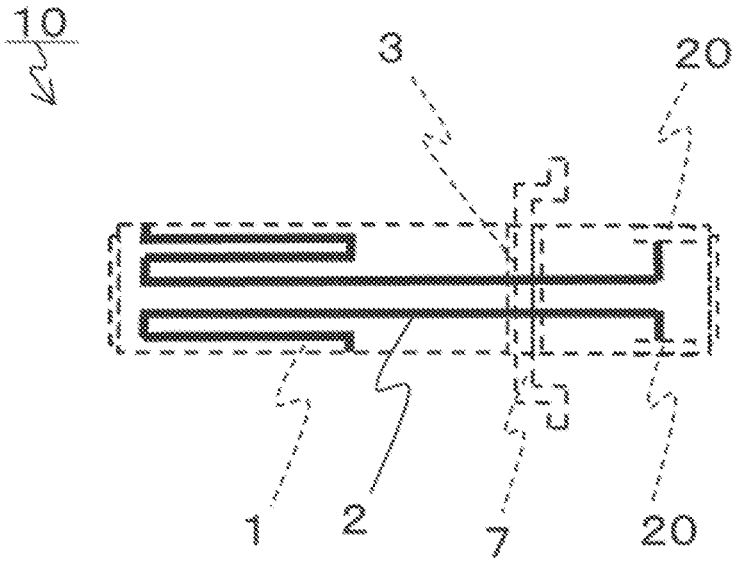
FIG. 2 is a transparent side view illustrating a heat generating resistor in the heater.

A heater 10 according to one embodiment will be described with reference to drawings below. FIG. 1 is a side view illustrating the heater 10. As illustrated in FIG. 1, the heater 10 includes a ceramic body 1 and a flange 7. The heater 10 can be used, for example, as a liquid heater that heats a fluid such as a liquid (water or the like) as an object to be heated. Furthermore, as illustrated in FIG. 2, a heat generating resistor 2 is disposed in the interior of the ceramic body 1.

The ceramic body 1 of the embodiment is a cylindrical member having a flow channel for a fluid in an internal space thereof. In the heater 10 of the embodiment, the ceramic body 1 has, but not limited to, a cylindrical shape. Specifically, the ceramic body 1 may have a pillar shape. In this case, the heater 10 is used to heat an object to be heated by bringing the object to be heated into contact with an outer peripheral surface of the ceramic body 1 and transmitting heat emitted from the heat generating resistor 2 from the outer peripheral surface of the ceramic body 1.

The ceramic body 1 of the heater 10 of the embodiment is a cylindrical member having a longitudinal direction. The ceramic body 1 is formed of, for example, insulating ceramics such as oxide ceramics, nitride ceramics, or carbide ceramics. Specifically, the ceramic body 1 is formed of ceramics such as alumina ceramics, silicon nitride ceramics, aluminum nitride ceramics, or silicon carbide ceramics. Among others, from the viewpoint of oxidation resistance, it is preferable that the ceramic body 1 is formed of alumina ceramics.

The dimensions of the ceramic body 1 can be set as follows, for example. Specifically, the entire length in the longitudinal direction can be set to fall within a range of approximately 40 to 150 mm, an outer diameter can be set to fall within a range of approximately 4 to 30 mm, and an inner diameter can be set to fall within a range of approximately 1 to 28 mm.

As illustrated in FIG. 2, the heat generating resistor 2 is disposed in the interior of the ceramic body 1. The heat generating resistor 2 generates heat by electric current flowing therein. The heat generating resistor 2 is embedded in the interior of the ceramic body 1 along a flow channel. Although not illustrated completely in FIG. 2, the heat generating resistor 2 is disposed on a front end side (left side in the drawing) of the ceramic body 1 also in a circumferential direction thereof along the outer peripheral surface of the ceramic body 1. More specifically, the heat generating resistor 2 is disposed so as to surround the flow channel while meandering.

The heat generating resistor 2 is formed of a conductor mainly containing, for example, a metal with high melting point such as tungsten (W), molybdenum (Mo) or rhenium (Re). The dimensions of the heat generating resistor 2 can be set in such a manner that the width falls within a range of approximately 0.3 to 2 mm, the thickness falls within a range of approximately 0.01 to 0.1 mm, and the entire length falls within a range of approximately 500 to 5000 mm. These dimensions can be appropriately set according to the heat generating temperature of the heat generating resistor 2 and a voltage to be applied to the heat generating resistor 2.

The ceramic body 1 is provided with electrodes 20 on a surface on a rear end side (right side in the drawing) thereof. The electrodes 20 are members configured to electrically connect an external power source and the heat generating resistor 2, and are disposed on the ceramic body 1 at two points on the rear end side. The electrodes 20 are electrically connected to the heat generating resistor 2. The electrodes 20 are formed of a metallic material such as tungsten or molybdenum, for example.

The flange 7 is a member for facilitating attachment of the ceramic body 1 on external equipment. Examples of the external equipment include an electronic bidet. In a case where the heater 10 of the embodiment is used for the electronic bidet, the heater 10 is used to heat up water for shower in the electronic bidet to become warm water by allowing the water to pass through the interior (a flow channel defined by a wall surface which corresponds to an inner peripheral surface of a cylinder) of the ceramic body 1. Specifically, for example, the water is introduced from the rear end side of the ceramic body 1, the water is heated by the heat generating resistor 2 while the water passes through the flow channel in the interior of the ceramic body 1, and then is discharged from the front end side of the ceramic body 1 as warm water. At this time, the warm water discharged from the front end side of the ceramic body 1 may be adhered to an outer surface of the ceramic body 1. Therefore, occurrence of leakage of electricity caused by contact of water with the electrodes 20 disposed on the rear end side of the ceramic body 1 needs to be prevented. In the case where the heater 10 is used for the electronic bidet, the flange 7 serves to prevent the warm water from being adhered to the electrodes 20 and consequently prevent leakage of electricity.

Heating of water (object to be heated) by the heater 10 may be achieved not only by the flow channel in the interior of the ceramic body 1, but also by the outer surface of the ceramic body 1. Also, heating of water (object to be heated) by the heater 10 may be achieved by both of the flow channel in the interior and the outer surface of the ceramic body 1.

The flange 7 is an annular member, and into which the ceramic body 1 is inserted. In the heater 10 of the embodiment, the flange 7 has two bent portions in the course from an inner periphery to an outer periphery thereof. Specifically, the flange 7 includes a first portion 71 which rises vertically from the metallic layer 3 toward an outer peripheral side, a second portion 72 which extends from an end of the first portion 71 on the outer peripheral side toward the rear end side, and a third portion 73 which extends from the rear end of the second portion 72 toward the outer peripheral side. Accordingly, two bent portions are formed by the first portion 71 and the second portion 72, and by the second portion 72 and the third portion 73, respectively.

The flange 7 is formed of a metallic material such as stainless steel or ion-cobalt-nickel alloy for example. Specifically from the viewpoint of corrosion resistance, it is preferable that the flange 7 is formed of stainless steel. The dimensions of the flange 7 can be set as follows, for example. Specifically, the inner diameter of the first portion 71 can be set to be substantially the same as the outer diameter of the ceramic body 1, and the outer diameter of the third portion 73 can be set to fall within a range of approximately 8 mm to 50 mm. The length (length of the second portion 72) of the ceramic body 1 in the longitudinal direction can be set to fall within a range of approximately 0.3 mm to 5 mm, for example. In this embodiment, the flange 7 is formed of a metallic material, but is not limited thereto. Specifically, a ceramic material, a resin material, or the like can be used in accordance with the application thereof.

Figure 3:
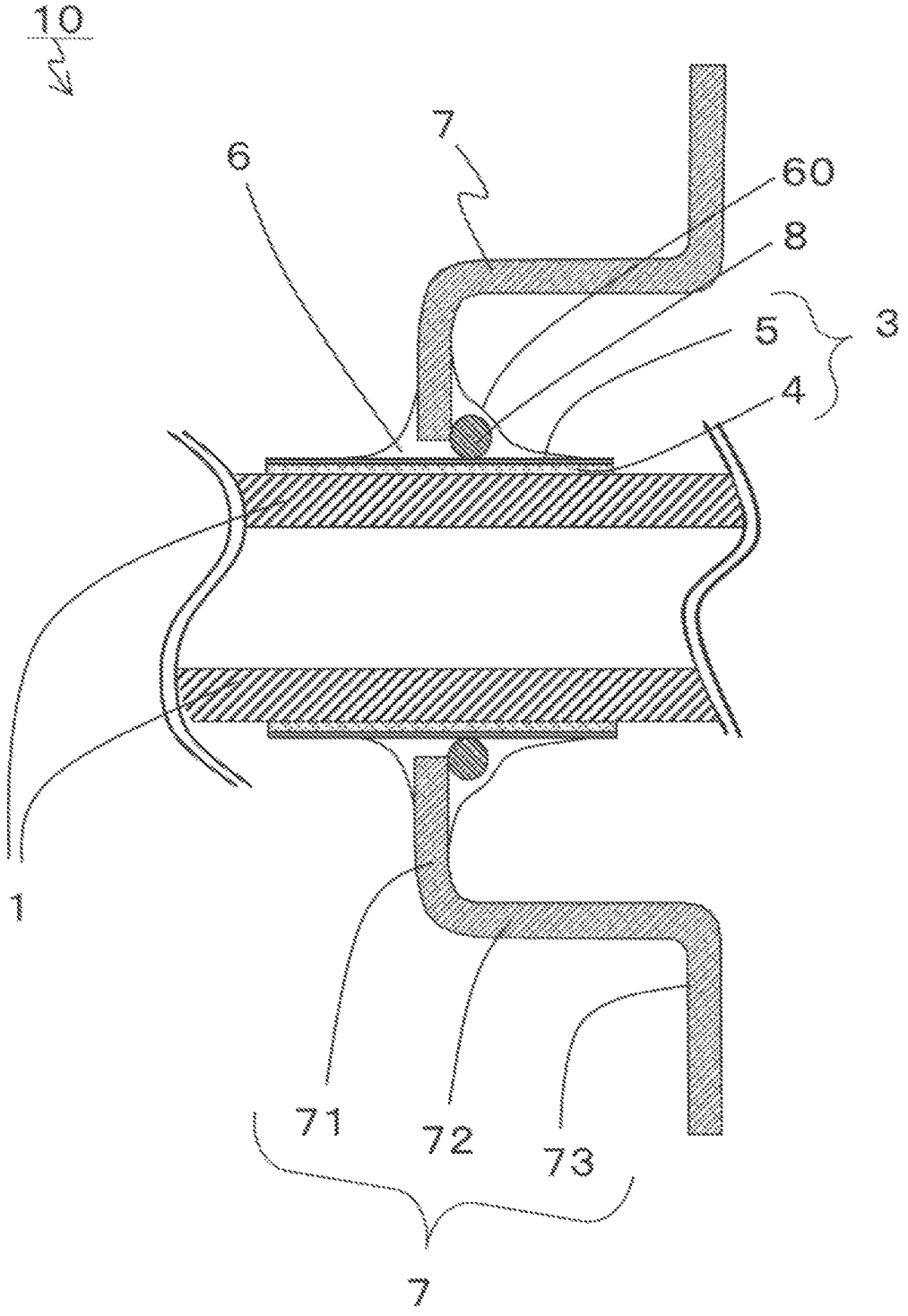
FIG. 3 is a partially enlarged drawing illustrating the heater shown in FIG. 1.

As illustrated in FIG. 3, in the heater 10 of the embodiment, the metallic layer 3 is formed on a region of the outer peripheral surface of the ceramic body 1 where the flange 7 is to be attached, and the metallic layer 3 and the flange 7 are bonded with a bonding material 6. The metallic layer 3 is disposed on the outer peripheral surface of the ceramic body 1 and extends along the circumferential direction. The metallic layer 3 is disposed not only between the flange 7 and the ceramic body 1, but also extends therefrom to the front end side and the rear end side of the ceramic body 1. Accordingly, a large bonding region between the metallic layer 3 and the flange 7 is achieved. Specifically, both parts of the flange 7 on the front end side and the rear end side of the ceramic body 1 can be bonded to the metallic layer 3.

In other words, when viewing a cross section of the ceramic body 1 including the longitudinal direction, the width of the metallic layer 3 is larger than the width of the flange 7. Accordingly, the bonding material 6 can be wettably spread in a wide range of the metallic layer 3, so that a bonding strength between the flange 7 and the metallic layer 3 can be improved.

As the metallic layer 3, for example, a metalized layer 4 formed of tungsten, molybdenum or the like can be used. The bonding material 6 can be appropriately selected from materials for bonding the metallic layer 3 and the flange 7. In the heater 10 of the embodiment, a brazing material is used as the bonding material 6. As the brazing material, for example, silver or silver-copper braze can be used. In particular, as illustrated in FIG. 3, wettability of the metallic layer 3 and the brazing material may be improved by employing a composite layer including the aforesaid metalized layer 4 and a plating layer 5 as the metallic layer 3. Accordingly, the bonding strength between the ceramic body 1 and the flange 7 can be improved. As such a plating layer 5, a nickel layer can be used.

In addition, in the heater 10 of the embodiment, the bonding material 6 includes a meniscus part 60 which extends from the metallic layer 3 to the flange 7. The entire shape of the bonding material 6 may include only the meniscus part 60, or the bonding material 6 may include a portion other than the meniscus part 60.

In the interior of the meniscus part 60, a metallic wire 8 is disposed on the outer peripheral surface of the ceramic body 1 and extends along the circumferential direction. Accordingly, the metallic layer 3 and the flange 7 can be bonded with a small amount of the bonding material 6 over the entire circumference of the ceramic body 1. In addition, the bonding material 6 can be wettably spread along the metallic wire 8 by applying the bonding material 6 after the metallic wire 8 is disposed along the circumferential direction of the ceramic body 1.

Accordingly, the amount of the bonding material 6 can be reduced, and the amount of thermal expansion of the bonding material 6 under a heat cycle can be reduced. Accordingly, a thermal stress generated between the bonding material 6 and the ceramic body 1 or between the bonding material 6 and the flange 7 can be reduced. Therefore, the risk of cracking of the bonding material 6 can be reduced. Consequently, a long-term reliability of the heater 10 can be improved.

In addition, it is preferable that the metallic wire 8 has a coefficient of thermal expansion higher than that of the ceramic body 1. When bonding the metallic layer 3 and the flange 7, the metallic wire 8 is also bonded. Here, when the metallic wire 8 and the metallic layer 3 are cooled from a high temperature to a room temperature after having been bonded with the bonding material 6, a compression stress is applied from the metallic wire 8 to the ceramic body 1. In contrast, when the coefficient of thermal expansion of the metallic wire 8 is lower than that of the ceramic body 1, a tensile stress which pulls the ceramic body 1 is applied from the metallic wire 8 via the bonding material 6 and the metallic layer 3. The ceramic body 1 formed of ceramics has higher resistance against the compression stress than against the tensile stress. When the metallic wire 8 has a coefficient of thermal expansion higher than that of the ceramic body 1 as described above, reliability under the heat cycle can be improved.

In particular, it is preferable that the metallic wire 8 has a coefficient of thermal expansion higher than that of the ceramic body 1, and the metallic wire 8 is in contact with both of the ceramic body 1 and the metallic layer 3. Accordingly, when the compression stress is applied from the metallic wire 8 to the ceramic body 1 by being cooled from the high temperature to the room temperature, the metallic wire 8 tightens a corner portion formed between the ceramic body 1 and the flange 7. Consequently, the heater 10 improved in sealing properties between the ceramic body 1 and the flange 7 can be obtained.

Further, it is preferable that the metallic wire 8 is in contact with the metallic layer 3 and the flange 7. Since the bonding material 6 is spread along the metallic wire 8, the bonding material 6 can be distributed all over the circumference of the flange 7 owing to contact of the metallic wire 8 with the metallic layer 3 and the flange 7. Consequently, the bonding strength between the ceramic body 1 and the flange 7 can be improved.

Figure 4:
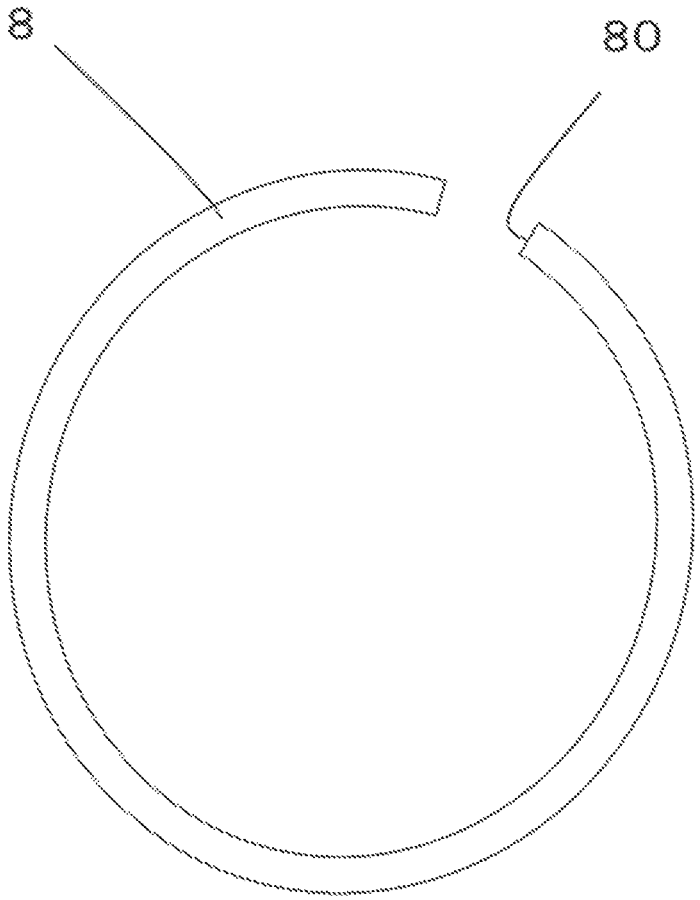
FIG. 4 is a schematic drawing illustrating a metallic wire of a heater according to a modified example.
Figure 5:
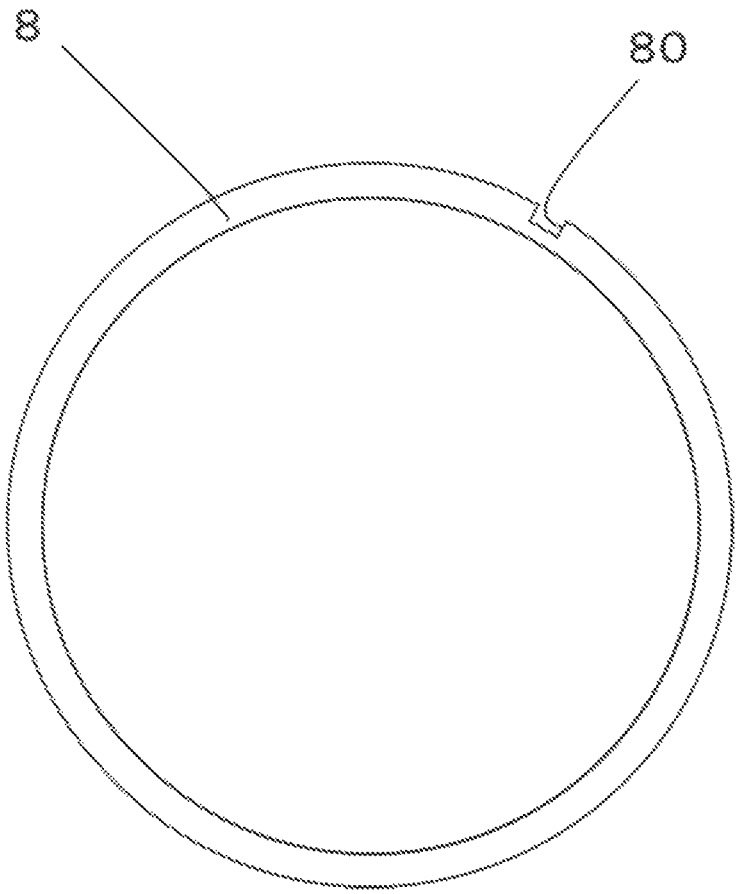
FIG. 5 is a schematic drawing illustrating a metallic wire of a heater according to a modified example.

Further, as illustrated in FIGS. 4 and 5, the metallic wire 8 may have an annular shape having a break 80. Accordingly, when the metallic wire 8 is subject to thermal extension, probability of deformation such that the metallic wire 8 is lifted from the metallic layer 3 can be reduced. Consequently, reliability of the heater 10 can be improved. The expression "annular shape having a break" used here may indicate, for example, the metallic wire 8 cut as illustrated in FIG. 4. In addition, the expression "annular shape having a break" may indicate, for example, the metallic wire 8 partly notched as illustrated in FIG. 5. In other words, the metallic wire 8 may have a shape having a depression. The depression may be provided on an outer peripheral surface of the metallic wire 8. The metallic wire 8 has a coefficient of thermal expansion higher on the outer periphery when compared between the outer periphery and the inner periphery. By providing a depression on the outer peripheral surface subjected to a higher thermal expansion, deformation of the metallic wire 8 can be reduced.

Furthermore, it is preferable that the metallic wire 8 has a thermal conductivity lower than that of the bonding material 6. Accordingly, conduction of heat transferred from the ceramic body 1 to the flange 7 can be suppressed. Consequently, when the heater 10 is used, escape of heat from the flange 7 can be reduced.

The metallic wire 8 may be covered entirely with the bonding material 6. Accordingly, since an interface between the metallic wire 8 and the bonding material 6 is not exposed to the outside, the progress of corrosion from the interface between the metallic wire 8 and the bonding material 6 can be reduced.

Figure 6:
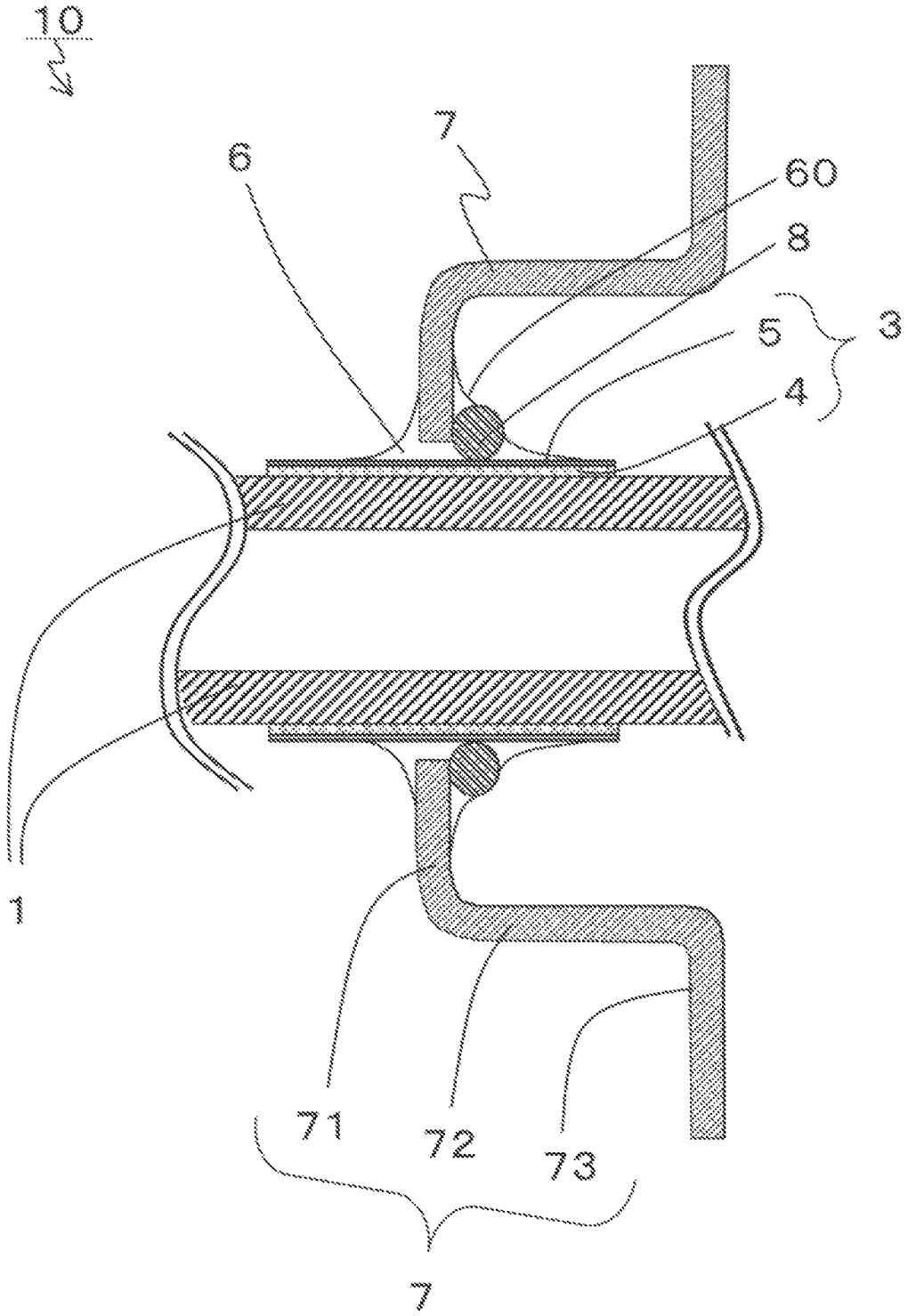
FIG. 6 is a partially enlarged drawing illustrating a heater according to a modified example.

Also, as illustrated in FIG. 6, part of the metallic wire 8 may be exposed to the outside. With the metallic wire 8 exposed to the outside, the thermal stress to be generated between the bonding material 6 and the metallic wire 8 can reduced. This is because part of the metallic wire 8 not covered with the bonding material 6 is more likely to thermally expand outward. In such a case, part of the metallic wire 8 is exposed to part of the surface of the bonding material 6. In such a case as well, if the surface of the bonding material 6 has substantially a meniscus shape, the bonding material 6 may be considered to have the meniscus part 60.

In the heater 10 of the embodiment, the metallic wire 8 is disposed on the rear end side with respect to the flange 7. In other words, the metallic wire 8 is located at a position farther from the heat generating resistor 2 than the flange 7. Accordingly, this can be less affected by heat from the heat generating resistor 2 disposed on the front end side of the ceramic body 1. Consequently, the risk of occurrence of corrosion on the metallic wire 8 can be reduced. In particular, when the heater 10 is used for heating water, by disposing the metallic wire 8 on the rear end side with respect to the flange 7, the risk that the metallic wire 8 gets wet by water can be reduced.

The amount of the bonding material 6 may be larger on the rear end side than on the front end side when viewed from the flange 7. Accordingly, this can be less affected by heat from the heat generating resistor 2 on the bonding material 6. Consequently, the risk of cracking in the bonding material 6 can be reduced.

In the embodiment, the metallic wire 8 is disposed only on the rear end side with respect to the flange 7, but the invention is not limited thereto. Specifically, the metallic wire 8 may be disposed only on the front end side of the flange 7, or may be disposed separately on both of the front end side and the rear end side.

In the embodiment, although the bonding material 6 is in contact only with the first portion 71 of the flange 7, but the invention is not limited thereto. Specifically, the bonding material 6 may be wettably spread over the second portion 72 of the flange 7. In this manner, strength of the bonding between the flange 7 and the metallic layer 3 can be made stronger by wettably spreading the bonding material 6 also over the second portion 72 of the flange 7 which extends to the rear end side.

As the metallic wire 8, for example, a nickel wire, an iron wire, or a cobalt alloy wire can be used. In reducing the thermal conductivity of the metallic wire 8 to a level lower than the thermal conductivity of the bonding material 6, for example, the metallic wire 8 may be formed of a nickel wire and silver solder may be used as the bonding material 6. In this case, the thermal conductivity of the metallic wire 8 can be set to approximately 90.9 W/mK, and the thermal conductivity of the bonding material 6 can be set to approximately 420 W/mK.

The shape of the metallic wire 8 is, for example, circular in cross section. The dimensions of the metallic wire 8 can be set in thickness to fall within a range of approximately 0.2 to 0.8 mm in diameter, and in length to fall within a range of approximately 23 to 160 mm, for example. In the case that the metallic wire 8 has a break as described above, the dimension of the break in the circumferential direction of the metallic wire 8 can be set to fall within a range of approximately 0.1 to 3 mm, for example. In the case where the break is a depression, the depth of the depression may be set to fall within a range of approximately 10 to 70% of the thickness of the metallic wire 8, for example.

REFERENCE SIGNS LIST

1: Ceramic body
2: Heat generating resistor
3: Metallic layer
4: Metalized layer
5: Plating layer
6: Bonding material
60: Meniscus part
7: Flange
8: Metallic wire
10: Heater

The invention claimed is:

1. A heater, comprising:

a ceramic body having a pillar or cylindrical shape;

a heat generating resistor disposed in the ceramic body;

a metallic layer which is disposed on an outer peripheral surface of the ceramic body and extends in a circumferential direction thereof;

a flange which is an annular member disposed on the metallic layer, comprising a bottom surface facing to the outer peripheral surface and a side surface connected to the bottom surface, wherein the bottom surface and the side surface are bonded to the metallic layer with a bonding material; and a metallic wire which extends in the circumferential direction along the side surface, and is bonded to the side surface and the metallic layer in a circumferential direction with the bonding material.

2. The heater according to claim 1, wherein the metallic wire has a coefficient of thermal expansion higher than that of the ceramic body.

3. The heater according to claim 1, wherein the metallic wire is in contact with the metallic layer and the side surface of the flange.

4. The heater according to claim 1, wherein the metallic wire has an annular shape with a break.

5. The heater according to claim 1, wherein the metallic wire has a thermal conductivity lower than that of the bonding material.

* * * * *